United States Patent [19]

Sachs

[11] 4,166,688

[45] Sep. 4, 1979

[54] AUTOMATIC PHOTOGRAPHIC FILM PROCESSOR AND FLUID-TIGHT SEALS THEREFOR

[76] Inventor: Emanuel M. Sachs, 24 Franklin St., Watertown, Mass. 02172

[21] Appl. No.: 792,055

[22] Filed: Apr. 28, 1977

[51] Int. Cl.[2] ..... G03D 3/08

[52] U.S. Cl. ..... 354/319; 354/331; 134/122 P; 118/405

[58] Field of Search ..... 354/301, 305, 317, 318, 354/319, 320, 321, 322, 323, 331; 68/22 B, 5 E; 118/262, 405, 419, 50; 34/242; 29/123, 129.5; 134/64 P, 122 P

[56] References Cited

U.S. PATENT DOCUMENTS

| | | | |
|---|---|---|---|
| 1,946,627 | 2/1934 | Karrer | 68/22 B |
| 2,693,879 | 11/1954 | Gehrman | 34/242 |
| 2,781,655 | 2/1957 | Brown | 68/22 B |
| 3,057,282 | 10/1962 | Luboshez | 354/301 X |
| 3,315,370 | 4/1967 | Hikosaka | 34/242 |
| 3,367,667 | 2/1968 | Allen | 34/242 |
| 3,467,399 | 9/1969 | Kelly et al. | 118/50 |
| 3,908,410 | 9/1975 | Umehara et al. | 68/22 B |

*Primary Examiner*—L. T. Hix
*Assistant Examiner*—Alan Mathews
*Attorney, Agent, or Firm*—Weingarten, Maxham & Schurgin

[57] ABSTRACT

An automatic photographic film processor or like device for treating sheets of materials of the type provided with a plurality of approximately equal-length, annularly arranged parallel rollers positioned in longitudinally contacting relation to form the periphery of a chamber adapted to contain a processing solution, fluid-tight seals being provided between the ends of such rollers and flat side plates. The rollers are each comprised of a rigid shaft having a resilient covering of a thickness at least comparable to that of the roller shaft. The end of the roller and the side plate are contoured so that a portion of the roller adjacent to the outer diameter thereof provides a seal when brought into flush contact with the side plate. This contouring also permits the rollers to be longitudinally compressed to assist in providing the seal, while providing strain relief to the roller end in the vicinity of the shaft.

6 Claims, 6 Drawing Figures

FIG. 1
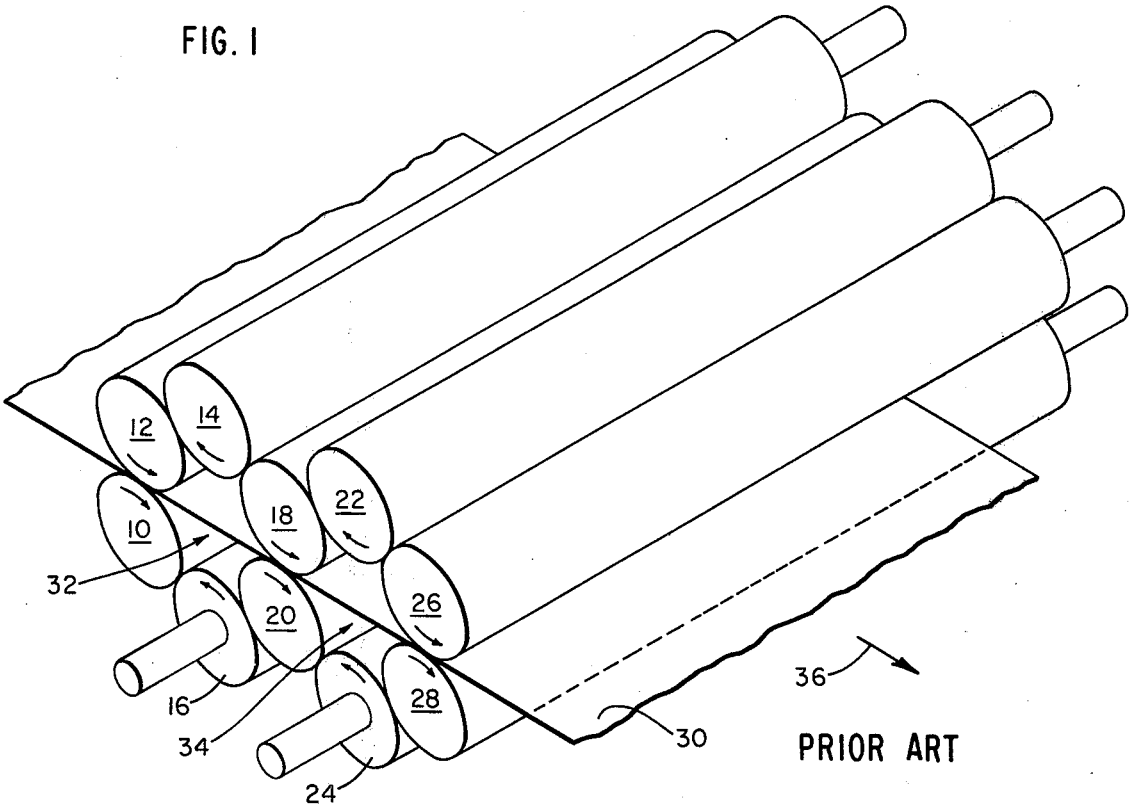
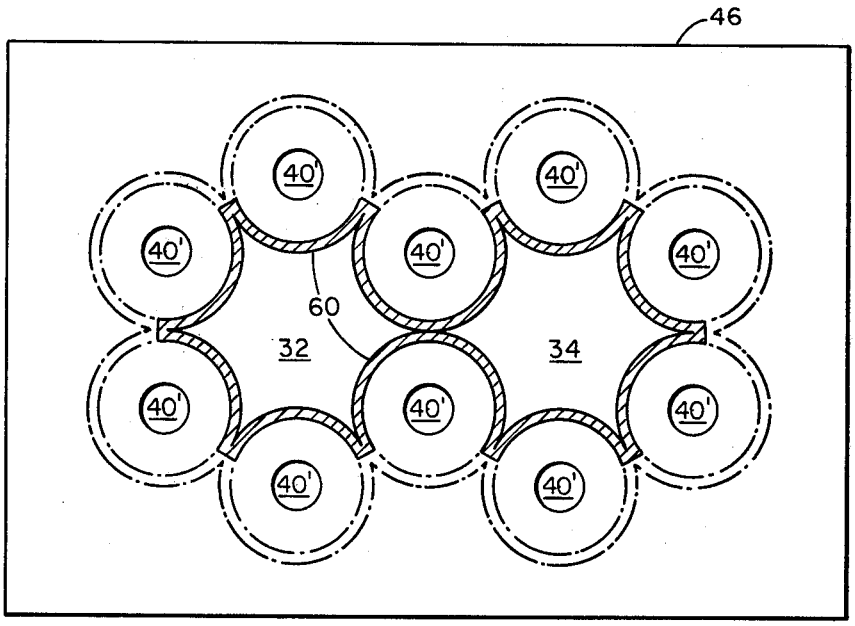
FIG. 6

AUTOMATIC PHOTOGRAPHIC FILM PROCESSOR AND FLUID-TIGHT SEALS THEREFOR

FIELD OF THE INVENTION

This invention relates to automatic photographic film processing devices or similar apparatus for fluid treating sheets of materials and, more particularly, to end seals for providing fluid-tight seals at the ends of the rollers used to transport the sheets of material being treated.

BACKGROUND OF THE INVENTION

As explained in U.S. Pat. No. 3,057,282, it is possible to provide a chamber for treating photographic film or other sheet material, the chamber being formed of a pair of parallel side plates and four or a greater even number of approximately equal-length rollers extending transversely between the side plates, each in rolling line contact with its neighbors and all rotatable about parallel longitudinal axes, so that the material to be processed may be passed between pairs of rollers into and out of said chamber. A recognized object of such structures is to avoid substantial leakage of fluid from or into the chamber, either between the rollers or between the ends of the rollers and the side plates. The present invention relates to a particularly effective design for accomplishing the seal between the rollers and the side plates.

While the aforementioned U.S. Pat. No. 3,057,282 discloses a means for sealing the rollers against the side plates, the sealing means described there is relatively expensive to manufacture and generally requires very accurately machined side plates combined with the use of a thick grease, graphite or similar material positioned between the ends of the rollers and the side plates to both reduce friction and aid in establishing a fluid-tight seal.

Accordingly, it is a principal object of the present invention to provide an inexpensive means for accomplishing a fluid-tight seal between the rollers and the side plates of a material processor of the type described.

Another object of the present invention is to provide a sealing means which does not require accurately machined side plates.

A further object of the invention is to provide a sealing means for the ends of the rollers which does not require the use of grease, graphite, pastes, sealing compounds or the like either to aid in the fluid-tight seal or to reduce friction between the ends of the rollers and the side plates.

It is still another object of the invention to provide a sealing means for the ends of resilient rollers having rigid shafts which prolongs the useful life of the rollers by reducing stresses which tend to separate the resilient material of the rollers from their shafts.

BRIEF SUMMARY OF THE INVENTION

In accordance with the teachings of the present invention, a seal is provided between the rollers of a film processing device of the type described and the side plates of the device. In contrast with the prior art teachings of a very simply-shaped roller and side plate combination with the roller having a flat end bearing against an accurately machined flat side plate to form a sealing surface across substantially the entire cross-section of the roller body or, alternatively, the use of elaborately shaped components to effectuate sealing, the present invention contemplates the use of both a simply-shaped roller and a simply-shaped side plate, neither of which requires precise machining. Further, in the design herein enclosed, only a portion of the cross-sectional area of each roller body is employed as a region of contact and sealing between the roller ends and the side plates. The region of sealing contact between an end of any one roller and the corresponding side plate as herein disclosed is preferably an arcuate segment concentric with the roller, and lying within the area projected on the side plate by the end of the roller. The sealing region is formed by employing either (1) a roller with a flat end and a side plate relatively recessed in the region adjacent the roller shaft and relatively raised along a region within the area of projection of the end of the roller on the side plate or (2) a flat side plate in combination with a roller which is relatively recessed in the region adjacent that where the roller joins its shaft. A shallower recess may be provided in the end of the roller to accommodate a washer of low friction material, such as the plastic material known by the trademark TEFLON.

Of course, it is necessary that the rollers be longitudinally compressed between the side plates to provide an effective seal. This will, unfortunately, induce strain tending to pull the roller body free from the shaft. By contouring the roller ends/side plates as described, however, strain relief is built into the seals, so that the roller body will not be pulled away from the shaft by either the longitudinal compression or rotation of the roller.

BRIEF DESCRIPTION OF THE DRAWING

These and other features of the present invention are more fully set forth below in the detailed description of the preferred embodiment presented below for purposes of illustration, and not by way of limitation, and the accompanying drawing of which:

FIG. 1 is a pictorial, perspective view of one embodiment of the present invention showing the arrangement of the rollers to form a fluid-tight periphery for two processing chambers;

FIG. 6 is a diagrammatic representation of the locus formed by the seal of a preferred embodiment of the present invention as projected onto a side plate for two six-roller chambers.

DESCRIPTION OF THE PREFERRED EMBODIMENT

Figure 2:
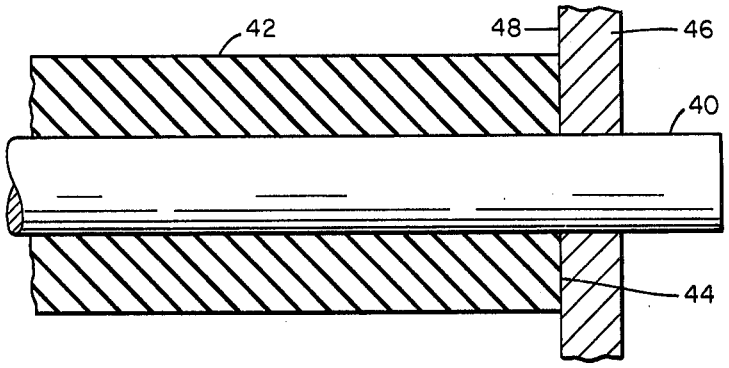
FIG. 2 is a sectional view of a prior art roller and side plate combination, the section being taken through the longitudinal axis of the roller and shaft therefor.

The present invention contemplates an end seal for the rollers of an apparatus for fluid treating sheet materials, for example, in an automatic photographic film processing device. The rollers considered are of the type having a rigid core or shaft and a resilient covering or body, preferably of thickness at least comparable to the shaft diameter. By arranging four or a greater even number of such rollers in parallel arrangement, annularly positioned, in peripheral contacting relation, the surfaces of the rollers themselves provide a sealed chamber open only at the opposite ends of the rollers, as shown in the aforementioned U.S. Pat. No. 3,057,282 and elsewhere. The fluid seal at the interfaces of the roller surface is effected by compression of the rollers; that is, the center to center distance between rollers is less than one roller diameter in the free, uncompressed state. The ends of the chambers so formed are sealed by side plates which butt up against the ends of the rollers, thereby slightly compressing the resilient roller body and completing the closure of the chambers. The manner of forming the seal between the ends of the rollers and the side plates is as generally discussed above and as more fully set forth in detail below.

Suitable holes may be provided in the side plates for pumping fluids into and emptying fluids from the processing chambers.

In the preferred embodiment, the rollers are formed of rubber cast on stainless steel shafts. The rubber used for the rollers is preferably of a type that will provide a non-wetting surface, such as a silicone rubber. This condition will permit a seal between chambers which is, for all practical purposes, leakage free both with the rollers turning and with the equipment turned off and the rollers idle. Silicone rubber provides such surface and is also practical for the reason that it can be cast directly to size without special equipment.

The material used for the side plates should be of a composition generally inert to the fluids employed within the chambers, as well as being resistant to frictional wear and having a low coefficient of sliding friction against the material used for the rollers. Nylon has been found to be suitable for the side plates in accordance with these criteria.

Referring now to FIG. 1, there is shown an arrangement for a set of equal diameter rollers 12–28 through which a sheet of photographic film or other material 30 may be fitted for processing. A first processing chamber 32 is formed by the interior peripheries of rollers 12–20, and a second chamber 34 is formed by the interior peripheries of rollers 18–28. The arrows on the rollers indicate their directions of rotation and arrow 36 indicates the direction of travel of the material being processed. As FIG. 1 is only a pictorial representation, the shafts or cores have been omitted from many of the rollers in order to make the figure more easily intelligible; however, it is to be understood that the rollers are all similarly constructed with a metal shaft and a resilient covering or body. Thus, any explanation as to the structure of one roller is intended to apply to all. Also, the use of six equal-sized rollers per chamber is intended to be illustrative only for, as the aforesaid U.S. Pat. No. 3,057,282 shows, numerous combinations of rollers of various sizes may be employed and, indeed, it may be desirable to do so, especially when a curved material processing path is desired. The ends of the chambers are understood to be closed by a pair of oppositely disposed side plates, not shown.

The roller design of the prior art is shown in FIG. 2. A metal core or shaft 40 is provided, being covered with a resilient material which comprises the body of the roller 42. Shaft 40 is of greater length than body 42 and extends beyond the body on both ends of the roller. The end 44 of roller 42 is made as flat as possible to provide a good seal against side plate 46. Inside surface 48 of side plate 46 is finely machined to provide a flat surface against which the ends of the rollers will bear. A hole is provided for each roller in side plate 46 for receiving each roller shaft. It is to be understood that whereas only a portion of a roller and a portion of one side plate are shown, both ends of each roller and their corresponding side plates are constructed in like fashion, opposite portions being mirror images, and that the side plates are broken off only for ease of illustration. Operationally, of course, the side plates place the rollers under longitudinal compression, by means not shown.

Figure 3:
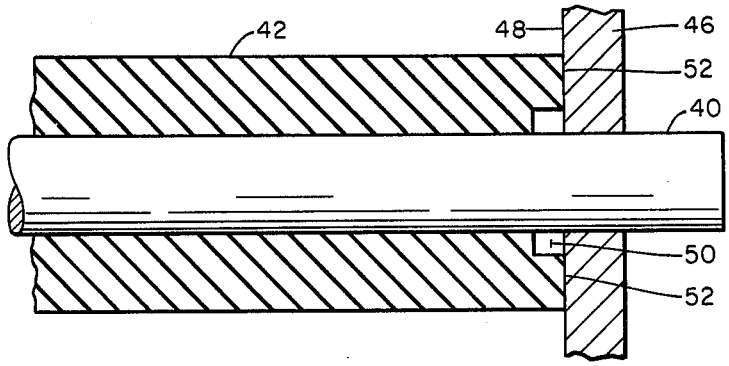
PRIOR ART FIG. 3
FIG. 3 is a similar sectional view of one type of roller and end plate combination according to the present invention, showing the recessed contouring of the end of the roller.

In FIG. 3 there is shown a first embodiment of the present invention. As shown in cross-section, the end of roller 42 is longitudinally strain relieved in the area adjacent the boundary between the shaft and the body of the roller by a cutaway or recessed portion indicated generally by numeral 50, thereby leaving an "elevated number" annular shoulder 52. When side plate 48 is brought into contact with shoulder 52 of the roller, it may be tightened thereagainst, compressing the roller lengthwise, without tearing the roller body away from the shaft where the end of the roller and the shaft meet, as would otherwise be the case with the arrangement shown in FIG. 2. Also, since this configuration permits a greater degree of longitudinal compression of the roller body than does the arrangement of FIG. 2, it is not necessary that the inner surface 48 of the side plate 46 be so carefully machined, as the compression of the resilient roller body will assist in providing the seal.

Figure 4:
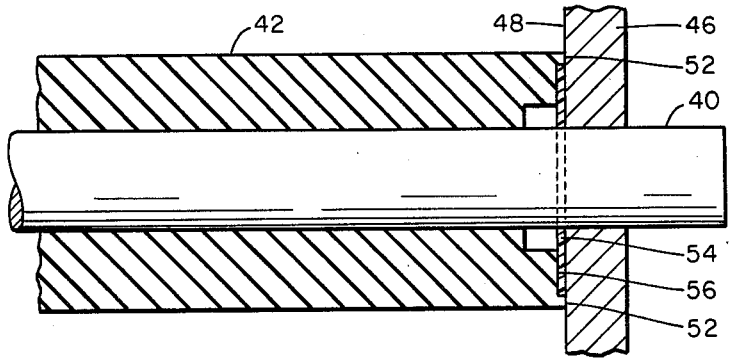
FIG. 4 is a cross-sectional view of another roller and side plate configuration for practicing the present invention, showing the recessed contouring of the end of the roller and the use of a teflon washer in combination therewith.

Another embodiment of the present invention is shown in FIG. 4. This embodiment is similar to that of FIG. 3; however, shoulder 52 has been modified to receive a washer 54 over a portion thereof. According to this modification, a portion of the shoulder 56 is recessed to provide a seat for a washer of a material such as the plastic material known by the trademark TEFLON. The depth of the recess providing the seat is slightly greater than the thickness of the washer. The washer is of an outer diameter to match the diameter of the seating surface in the end of the roller and has an inner diameter sufficiently large to receive the roller shaft. When assembled, the side plate bears upon and compresses the shoulder 52 until being brought into contact with the washer 54 and thereupon bears both against the washer and the shoulder of the roller end. By using a material such as the plastic material known by the trademark TEFLON for the washer, friction between the end of the roller and the side plate is significantly reduced; the TEFLON washer, while it occupies a substantial part of the surface of the roller end, readily slides over the nylon side plate, so that most of the friction at the roller end is attributable to the sliding of the shoulder against the side plate. Since an effective seal can be provided by a shoulder of very small radial extent, most of the roller end-side plate friction can be eliminated by this simple arrangement, without the use of sealing pastes or liquid lubricants which will require periodic replenishment and might be reactive with the chemicals being used for processing. It should also be recognized that a limited amount of frictional wear on the shoulders of such a roller may easily be compensated for by either reducing the spacing between the side plates or substituting a thinner washer for the one previously being used, or both.

Figure 5:
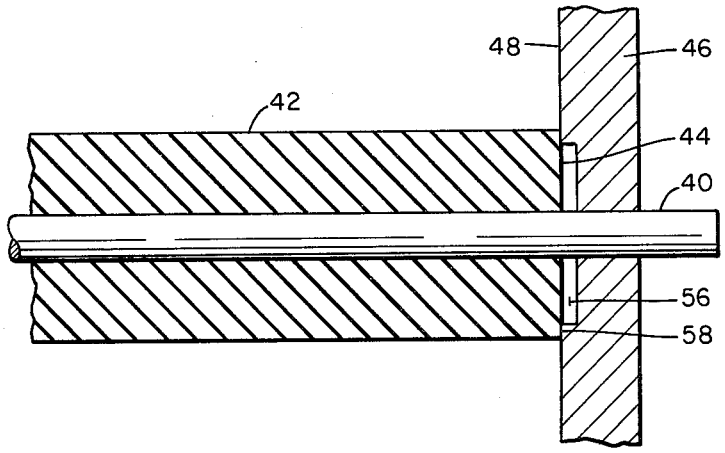
FIG. 5 is a cross-sectional view of still another combination of roller and side plate design for practicing the present invention, showing the recessed contouring of the side plate rather than the rollers.

A seal which is equivalent in effect to that of FIGS. 3 and 4 is shown in FIG. 5. However, in this embodiment, rather than contouring the end of the roller, it is the side plate which has been contoured. By making an annular recession 56 in the side plate concentric with the shaft-receiving opening therein, the surface of the side plate extending beyond such recess provides a shoulder 58 for bearing against the end of the roller, while the recess provides strain relief on the roller end-shaft joining area. As in FIG. 4, it is also possible to employ a washer to fill part of the recess, but the function of the washer in this case is not exactly the same as in the embodiment of FIG. 4 and, therefore, a washer in this embodiment will not provide precisely the same benefits and, unless properly designed, it may even reduce the stress elimination achieved without the use of the washer.

The sealing area provided by the present invention, according to any of the embodiments described, takes the form of a locus illustrated by the shaded region 60 in FIG. 6, when projected onto the side plate. It is to be appreciated, however, that other loci providing a closed path between the points of roller-to-roller contact and lying wholly within the area projected by the roller ends onto the side plate will provide a seal equally within the intent of this invention. Note also that in FIG. 6 the numerals 40' designate the holes provided in side plate 46 for receiving the roller shafts.

The present invention is not to be construed as limited to the specific embodiments described above, but extends to the modifications of and alternatives to these teachings which fall within the scope of the following claims.

What is claimed is:

1. In an automatic photographic film processor of the type provided with a plurality of annularly arranged parallel rollers positioned in longitudinally contacting relation to form the periphery of a chamber adapted to contain a processing solution, a pair of parallel side plates, the rollers being transversely disposed between the side plates, and wherein each of the rollers is comprised of a body portion of a resilient material and a metal shaft extending longitudinally therethrough, the improvement comprising:

means for longitudinally strain relieving at least one end of one of such rollers in the region of the body of such roller end adjacent the boundary between the shaft and the roller body; and means for providing a fluid-tight seal between the roller end and the side plate;

wherein said means for longitudinally strain relieving a roller end and said sealing means include the end of the body of such roller having an elevated annular shoulder and an annularly shaped recessed portion having:

a first annular recess of a first depth and radius and a second annular recess of second depth and radius, the radius of the second recess being greater than that of the first recess and the depth of the second recess being less than that of the first recess; and an annular washer having an inner diameter sufficient to receive the roller shaft and an outer diameter no greater than twice the radius of the second recess;

the washer having a thickness no greater than the height of the elevated annular shoulder of the roller end.

2. The apparatus of claim 1, wherein the washer is comprised of polytetra fluoro ethylene.

3. In an automatic photographic film processor of the type provided with a plurality of annularly arranged parallel rollers positioned in longitudinally contacting relation to form the periphery of a chamber adapted to contain a processing solution, a pair of parallel side plates, the rollers being transversely disposed between the side plates, and wherein each of the rollers is comprised of a body portion of a resilient material and a metal shaft extending longitudinally therethrough, the improvement comprising for each roller end:

means for longitudinally strain relieving the end of such roller in the region of the body of such roller end adjacent the boundary between the shaft and the roller body, said means including:

a first annular recess of sufficient depth and radius to provide strain relief of the roller end;

a second annular recess of greater diameter than said first recess;

an annular shoulder radially outward of said second recess and providing fluid-tight rotatable sealing engagement with the side plate; and an annular washer of low friction material disposed in said second recess and in low friction rotatable contact with the side plate and having an inside diameter sufficient to receive the roller shaft and an outside diameter to fit in said second recess.

4. The photographic film processor of claim 3 wherein said annular shoulder is flush with or slightly axially outward of said washer.

5. In an automatic photographic film processor of the type provided with a plurality of annularly arranged parallel rollers positioned in longitudinally contacting relation to form the periphery of a chamber adapted to contain a processing solution, a pair of parallel side plates, and wherein each of the rollers is comprised of a body portion of a resilient material having a substantially flat end, and a metal shaft extending longitudinally therethrough, the improvement comprising for each roller end:

means for longitudinally strain relieving the end of such roller in the region of the body of such roller end adjacent the boundary between the shaft and the roller body, said means including:

an annular recess in the side plate concentric with and having a greater diameter than a shaft-receiving opening therein, whereby the inner surface of the side plate extending beyond such recess provides a shoulder for fluid-tight rotatable sealing engagement with the end of the roller;

the annular recess being of a size to provide strain relief of the roller body end in the region thereof adjacent the shaft.

6. In an automatic photographic film processor of the type provided with a plurality of annularly arranged parallel rollers positioned in longitudinally contacting relation to form the periphery of a chamber adapted to contain a processing solution, a pair of parallel side plates, the rollers being transversely disposed between the side plates, and wherein each of the rollers is comprised of a body portion of a resilient material and a metal shaft extending longitudinally therethrough, a fluid-tight strain relieved end seal for each roller end comprising:

an annular shoulder having an outside circumferential surface which is an extension of the surface of the roller body and having an annular surface in fluid-tight rotatable sealing engagement with the side plate;

a low friction annular washer having an outside diameter substantially the same as the inside diameter of said annular shoulder and an inside diameter sufficient to receive said shaft, said washer being in low friction rotatable contact with the side plate;

a first annular recess radially inward of the shoulder in which said washer is seated; and a second annular recess radially inward of the first recess and of a size to provide strain relief of the roller end.

* * * * *